United States Patent [19]

Wilson et al.

[11] 3,934,631

[45] Jan. 27, 1976

[54] CLOTHES BAG AND SUSPENSION HANGER THEREFOR

[75] Inventors: Michael C. Wilson, Wheaton, Ill.; Leslie E. Schnick, Anchorage, Alaska

[73] Assignee: Pretty Products, Inc., Coshocton, Ohio

[22] Filed: Jan. 24, 1974

[21] Appl. No.: 436,109

[52] U.S. Cl. ..... 150/1; 150/1.8; 150/11; 248/99

[51] Int. Cl.[2] ..... A45C 11/00

[58] Field of Search ..... 190/43; 150/1.8, 1, 11; 248/94, 95, 99, 100, 101; 229/63

[56] References Cited

UNITED STATES PATENTS

| | | | |
|---|---|---|---|
| 245,823 | 8/1881 | Hedrick | 150/11 |
| 1,190,094 | 7/1916 | Born | 248/94 |
| 1,239,298 | 9/1917 | Norman | 150/1.8 |
| 1,476,423 | 12/1923 | Salisbury | 150/1.8 |
| 2,731,142 | 1/1956 | Miley | 150/1 X |
| 3,027,065 | 3/1962 | Lindquist | 229/53 |
| 3,180,384 | 4/1965 | Seifert | 248/95 X |
| 3,201,072 | 8/1965 | DuBois | 248/99 |

FOREIGN PATENTS OR APPLICATIONS

| | | | |
|---|---|---|---|
| 1,815,905 | 9/1970 | Germany | 229/63 |

*Primary Examiner*—William Price
*Assistant Examiner*—Stephen P. Garbe
*Attorney, Agent, or Firm*—Mahoney, Miller & Stebens

[57] ABSTRACT

A clothes bag and hanger is provided for vertical suspension of the bag from a supporting member. The hanger comprises a closed loop frame formed with a circumferential channel which opens radially outward. A hook-form hanger element is also formed with the frame for engagement with a support member. The clothes bag includes elongated front and rear wall panels of fabric sewn to form an open topped receptacle with the rear panel of greater length than the front panel resulting in the opening being in the plane of the panels and facing sideways. A drawstring sewn into a peripheral loop extending around the opening is utilized to secure the bag in the channel of the hanger from which the bag is then vertically suspended. A pleat formed in and extending longitudinally of the rear wall panel provides cross-sectional area expansion of the bag.

9 Claims, 5 Drawing Figures

CLOTHES BAG AND SUSPENSION HANGER THEREFOR

BACKGROUND OF THE INVENTION

Clothes bags heretofore provided in the prior art comprise in general, fabric bag formed with an open top and provided with a drawstring type closure. Although effective in the primary function of holding clothes, such prior art clothes bag do not provide a neat appearance as they are either stored on the floor in a closet or are suspended from a hook by means of the drawstring.

Utilization of a clothes bag merely stored on the floor is inconvenient as it must be picked up and held while attempting to simultaneously maintain the top open and either insert or remove articles of clothing. In the case of a clothes bag suspended from a hook by means of the drawstring, the opening will be closed and must first be opened. In either case, utilization is inconvenient and difficult thereby materially detracting from usefulness of prior art clothes bags for storage.

SUMMARY OF THE INVENTION

A clothes bag embodying this invention may be readily suspended from a support element and will hang in a vertical plane. The opening will be maintained in a full open position thereby greatly enhancing usefulness and convenience of use. Clothes may be single-handedly inserted or removed through the always open top.

A clothes bag and hanger constructed in accordance with this invention comprises a bag formed from a fabric material having a top opening which faces sideways and a hanger that includes a peripheral frame which is suspended in a vertical plane. The bag is secured to the frame with the bag opening mounted on the peripheral frame. This results in the bag being advantageously suspended in a vertical plane. A drawstring type of attachment permits removal or interchange as may be desired.

In addition to the primary advantages of neatness in vertical suspension and always having the top open, the bag is constructed to readily accommodate a relatively large quantity of clothes without materially affecting the vertical suspension. This construction of the bag involves formation of an elongated pleat in one sidewall of the bag and extending longitudinally thereof to readily permit expansion or enlargement of the cross-sectional area of the bag for greater capacity without resulting in distortion at the top opening.

These and other advantages and objectives of this invention will be readily apparent from the following detailed description of an embodiment thereof and the accompanying drawings.

DESCRIPTION OF THE DRAWING FIGURES

DETAILED DESCRIPTION OF THE ILLUSTRATIVE EMBODIMENT

Figure 1:
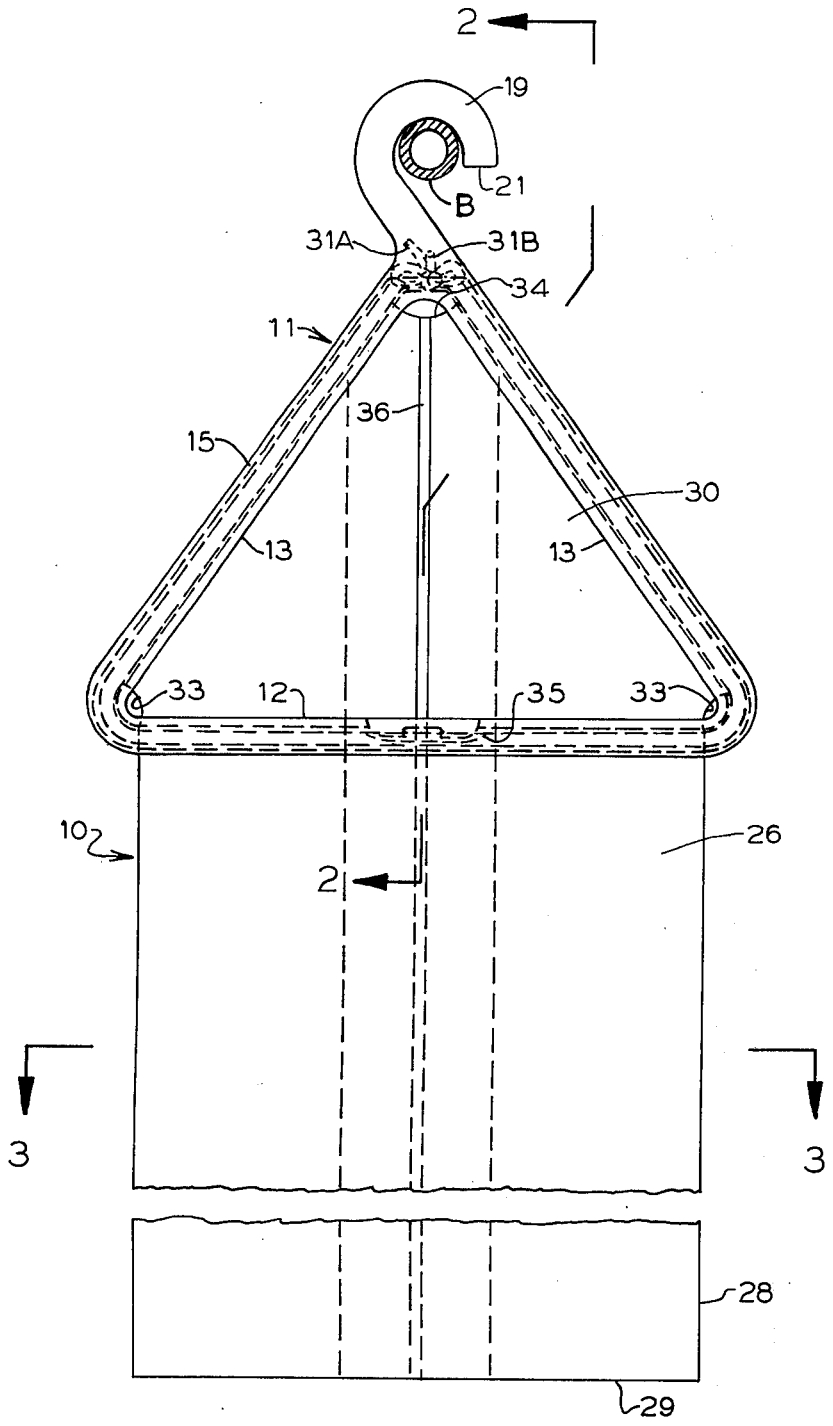
FIG. 1 is a front elevational view of a clothes bag and hanger embodying this invention.

A receptacle or clothes bag 10 and hanger 11 are shown in assembled relationship in FIG. 1 as suspended from a support member. For purposes of example, this support member is indicated as a clothes bar B such as is found in closets but it will be understood that utilization is not so limited.

The hanger 11 is a rigid frame formed from any suitable material exhibiting the desired structural strength characteristics. A synthetic thermoplastic or thermosetting resin of any of the well known types may be utilized. In the illustrative embodiment, the frame includes three peripheral elements designated as a base element 12 and side elements 13 which are integrally formed in a triangular configuration. Each side element 13 joins with a respective end of the base element 12 and are joined together at an apex 14 with the peripheral frame elements thereby defining a triangularly shaped open area.

Figure 5:
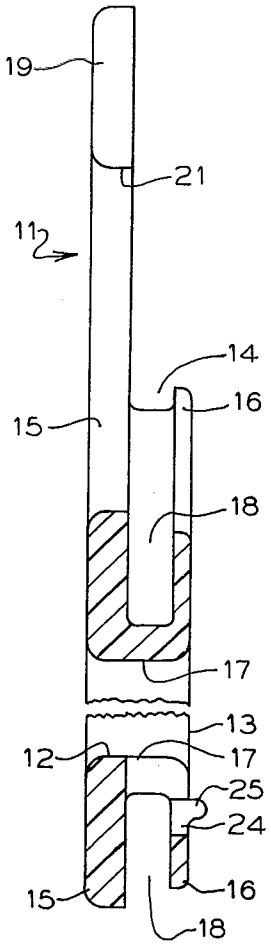
FIG. 5 is a fragmentary vertical sectional view of an enlarged scale taken along line 5—5 of FIG. 4.
Figure 4:
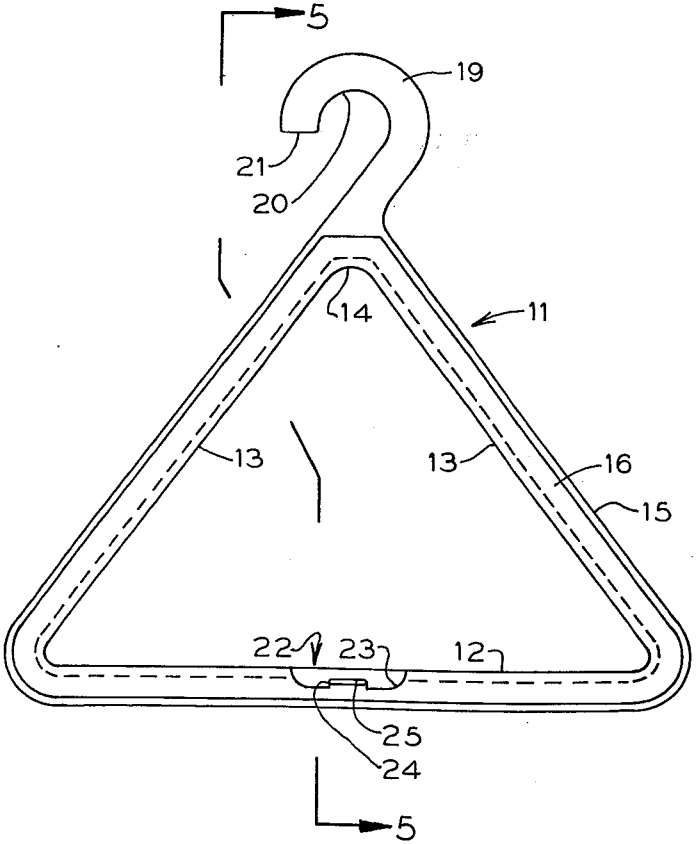
FIG. 4 is a rear elevational view of the hanger.

Each of the peripheral frame elements 12 and 13 is of the same general cross-sectional configuration which, as can be best seen in FIG. 4 and 5, is U-shaped. As such, each element includes spaced parallel flanges 15 and 16 interconnected by a web 17 which forms the inner wall of the frame. The flanges 15 and 16 with the web 17 define a channel 18 which opens radially outward and extends continuously around the three elements. One flange 15 is at the front of the hanger with the rear flange 16 being relatively shorter.

Attached to the apex 14 of the peripheral elements 13 is a hanger element 19. This hanger element 19 is a circularly shaped hook having an inner edge surface 20 of a diameter to receive a support member such as the clothes bar B illustrated in FIG. 1. A free end 21 of the hook is spaced from the shank to define an opening through which the bar B may readily pass. The hanger element 19 is preferably formed as an integral continuation of the front flange 15 at the apex 14 and extends vertically upward to center the hook over the apex for proper balance.

A central support 22 is formed in the base element 12 to engage the clothes bag 10 in this area for better support thereof. As can be best seen in FIG. 4 and the sectional views 2 and 5, this central support comprises an elongated opening 23 formed in the rear flange 15 and a portion of the web 17 at the center of the base element 12. Disposed centrally of the opening 23 is an upright extension 24 of the rear flange that terminates at the base of the channel 18. Formed with the extension 23 at the upper end thereof is an outwardly projecting lip 25 that extends a distance beyond the outer surface of the rear flange 16.

Figure 3:
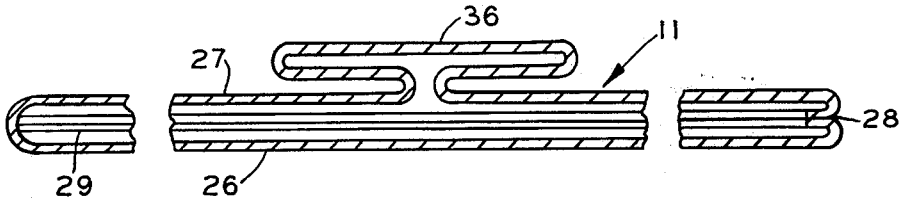
FIG. 3 is a horizontal sectional view on an enlarged scale taken along line 3—3 of FIG. 1.
Figure 2:
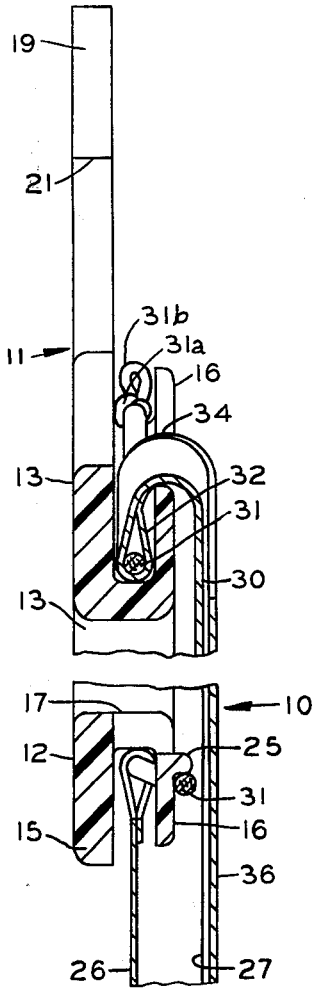
FIG. 2 is a fragmentary vertical sectional view on an enlarged scale taken along line 2—2 of FIG. 1.

Detachably assembled with the hanger 11 is the clothes bag 10 which is a flexible-walled receptacle. The clothes bag comprises a main body including front and rear wall panels, 26 and 27 respectively, that are formed from a suitable cloth fabric material as illustrated in FIGS. 1, 2 and 3. Both panels may be obtained from a single piece of fabric material forming an elongated tubular structure having a longitudinal side seam 28 and a bottom seam 29 which closes the bottom of the bag. Both front and rear wall panels are of a width substantially equivalent to the length of the base element 12.

An opening is formed at the opposite or top end of the clothes bag by extending the rear wall panel 27 a distance beyond the end of the front wall panel 26. This longitudinal extension 30 of the rear wall panel is triangularly configured to be substantially coextensive with the open area of the hanger 11. Around the peripheral edges of the front and rear wall panels 26 and 27 extends a drawstring 31 which runs through a loop 32 formed in each of the peripheral edges. Preferably, the loop 32 is discontinuous at each of the three corners in order that constriction of the drawstring will not result in an excessive bunching of the fabric at the corners associated with the peripheral edge of the front panel 26. Discontinuance of the peripheral edge loop 32 at the juncture of the two edges of the rear panel 27 is also necessary to provide an exit point for the drawstring 31. The loop 32 can be best seen in FIG. 2 with the drawstring 31 extending therethrough while the points of discontinuity can be seen in FIG. 1 and are designated by the numerals 33 and 34.

As is most clearly seen in FIG. 2, the clothes bag 10 is assembled with the hanger 11 by positioning the peripheral edges comprising the loop 32 with included drawstring in the channel 18 of the base and side elements 12 and 13. For assembly, the peripheral edge of the front wall panel 26 is positioned in the channel of the base element 12 while the two peripheral edges of the rear wall panel 27 are positioned in respective channels of the two side elements 13. When thus assembled, the drawstring 31 is pulled to tightly draw the loop 32 into the base of the channel 18 with the ends 31 and **31*b* of the drawstring being tied at the apex 14 thereby detachably securing the clothes bag 10 on the hanger 11.**

Accumulated weight of clothes deposited in the bag 10 through the aligned openings of the hanger 11 and the bag will tend to draw the peripheral edge loop 32 of the front wall panel 26 down from the illustrated straight line position shown in FIG. 1. To counter act this downward force, the central support 22 formed in the base element 12 is engaged with the peripheral edge of the front wall panel 26 providing a mid-span point of support. Engagement is facilitated by forming a discontinuity 35 in the loop 32 at the center of the front panel peripheral edge thereby exposing a length of the drawstring 31. This portion of the drawstring may then be pulled through the elongated opening 23 and looped over the upright extension 24 where it is retained by the outwardly projecting lip 25.

It is desirable that the hanger 11 remain in a substantially vertical plane regardless of the weight or volume of clothes that may be deposited in the bag 10. This requirement makes it necessary that the bag be capable of expanding in cross-sectional area throughout a substantial portion of its length but leave the front wall panel 26 in a relatively flat plane. In accordance with this invention, this is accomplished by providing the rear wall panel 27 with a relatively wide pleat 36 which extends the entire length of the rear wall panel. The lower end of this pleat 36 is sewn into the bottom seam 29 which the upper end is sewn into the loop 32 and seam for the discontinuity 34 at the apex of the rear wall panel 27. As will be readily understood with reference to the cross-sectional illustration of the bag 10 in FIG. 3, the rear wall panel 27 may readily expand in width to increase cross-sectional area without necessarily disturbing the front wall panel 26. The width of the pleat 36 may be of the order of ¼ to ⅓ the width of the bag to provide adequate expansion.

Utilization of the illustrated and described embodiment of this invention is believed readily apparent as are the obviously useful advantages of the novel structure. Although the hanger is only shown as being supported on a closet clothes bar in FIG. 1, it will be apparent that other types of support members may be used to equal advantage, such as a clothes hook mounted on a wall surface, for example. Also, while a triangular configuration is shown for the hanger, the hanger may be in the form of a square or a circle with only obvious adjustments in the clothes bag for adaptability to attachment to the hanger. Functional advantage of the pleat in formation of the clothes bag may also be obtain where the pleat is formed in the front wall panel, or both front and rear panels, as well as in the rear wall panel as illustrated.

It will be readily apparent that a novel clothes bag and suspension hanger is provided by this invention. The clothes bag and hanger are particularly adapted to suspension in a vertical plane requiring a minimum of closet space while maintaining the bag top open for convenience in utilization. The pleated bag construction provides for greater capacity without detracting from the desired vertical suspension.

Having thus described the invention what is claimed is:

1. A clothes bag and detachable suspension hanger comprising;

a rigid frame having peripheral elements defining a a predetermined open area in the plane of the elements and including a hanger element adapted to engage a support member for suspending said frame therefrom with the peripheral elements disposed in a substantially vertical plane, said peripheral elements being formed with a peripherally extending channel opening radially outward and having at least a portion of an element extending transversely to a vertical axis when said frame is vertically suspended with said portion disposed at a side of said frame opposite to said hanger element, said portion having a support element formed therewith, and a flexible-walled bag attached to said rigid frame in depending relationship, said bag having a main body including front and rear wall panels disposed in superimposed relationship with the rear panel extending a distance beyond the one end of the front panel and with peripheral edges of the front and rear panels at that end cooperatively defining an opening disposed in a plane parallel to the plane of the panels, said peripheral edges defining said opening provided with a drawstring for constrictively and releasably securing said peripheral edges in said channel of said frame to secure said bag thereto with the bag opening in alignment with the open area defined by the peripheral elements of said frame, said drawstring engageable with said support element for support of the bag.

2. A clothes bag and detachable suspension hanger according to claim 1 wherein the peripheral elements of said rigid frame form a closed loop.

3. A clothes bag and detachable suspension hanger according to claim 1 wherein said hanger element projects upwardly from the vertically disposed frame.

4. A clothes bag and detachable suspension hanger according to claim 1 wherein said bag is formed with a pleat extending vertically thereof in at least one of said wall panels providing cross-sectional area expansion.

5. A clothes bag and detachable suspension hanger according to claim 4 wherein said pleat extends the full length of said bag.

6. A hanger for a clothes bag comprising a rigid frame having peripheral elements defining a predetermined open area in the plane of the elements and a hanger element adapted to engage a support member for suspending said frame therefrom with the peripheral elements disposed in a substantially vertical plane, the peripheral frame elements having means cooperatively engageable with a clothes bag and which means includes a peripherally extending channel which opens radially outward, one of the peripheral elements of said rigid frame of elongated bar-form and disposed at a side of said frame opposite to said hanger element in transversely oriented relationship to a vertical axis of suspension and including a support element formed intermediate the ends thereof, said support element adapted to releasably engage with a clothes bag.

7. A hanger according to claim 6 wherein the peripheral elements of said rigid frame form a closed loop.

8. A hanger according to claim 6 wherein said one peripheral element has an opening to said channel formed therein intermediate the ends thereof and said support element is a hook-like projection disposed in said opening.

9. A clothes bag and detachable suspension hanger comprising;

a rigid frame having interconnected peripheral elements forming angular corners and defining a predetermined open area in the plane of the elements and including a hanger element adapted to engage a support member for suspending said frame therefrom with the peripheral elements disposed in a substantially vertical plane, and a flexible-walled bag attached to said rigid frame in depending relationship, said bag having a main body including front and rear wall panels disposed in superimposed relationship with the rear panel extending a distance beyond the one end of the front panel and with peripheral edges of the front and rear panels at that end cooperatively defining an opening disposed in a plane parallel to the plane of the panels, said peripheral edges defining said opening discontinuous at said angular corners and provided with a drawstring bridging said discontinuities to releasably engage with said frame to secure said bag thereto with the bag opening in alignment with the open area defined by the peripheral elements of said frame.

* * * * *